US005258115A

United States Patent [19]

Heck et al.

[11] Patent Number: 5,258,115

[45] Date of Patent: Nov. 2, 1993

[54] DELAYED COKING WITH REFINERY CAUSTIC

[75] Inventors: Roland H. Heck, Pennington; Tom Reischman, Lambertville, both of N.J.; Gerald J. Teitman, Vienna, Va.; Salvatore T. M. Viscontini, Northampton, Pa.

[73] Assignee: Mobil Oil Corporation, Fairfax, Va.

[21] Appl. No.: 945,780

[22] Filed: Sep. 16, 1992

Related U.S. Application Data

[63] Continuation-in-part of Ser. No. 779,657, Oct. 21, 1991, abandoned.

[51] Int. Cl.[5] ..... C10G 9/00

[52] U.S. Cl. ..... 208/131; 208/50; 208/132; 208/13

[58] Field of Search ..... 208/131

[56] References Cited

U.S. PATENT DOCUMENTS 2,626,892 1/1953 McCulley et al. ..... 208/131

5,009,767 4/1991 Bartilucci ..... 208/131

*Primary Examiner*—Helane Myers

*Attorney, Agent, or Firm*—Alexander J. McKillop; Malcolm D. Keen; Jessica M. Sinnott

[57] ABSTRACT

A refinery derived spent caustic is recycled by introducing the spent caustic to a delayed coking drum while conducting delayed coking of a hydrocarbon feedstock. The alkali metal containing material accelerates coking, induces production of shot coke, alleviates the problem of a hot drum and reduces drum cooling time.

15 Claims, 2 Drawing Sheets

DELAYED COKING WITH REFINERY CAUSTIC

CROSS REFERENCE TO RELATED APPLICATION

This is a continuation-in-part of copending application Ser. No. 07/779,657, filed on Oct. 21, 1991, now abandoned, which is incorporated herein by reference in its entirety.

FIELD OF THE INVENTION

The invention relates to a process for recycling spent refinery caustic or potash or a combination thereof and a method for producing a coker product. Specifically, the invention relates to coking spent caustic soda and/or caustic potash along with a coker feedstock in a delayed coker unit.

BACKGROUND OF THE INVENTION

The diminishing availability of high quality petroleum reserves encourages refiners to convert the greatest amount of low quality crudes to high quality light products such as gasoline. The majority of crudes which are currently available are very heavy, containing large amounts of low value residuum feeds which are unsuitable for catalytic cracking because of their tendency to foul or deactivate catalysts. These low value fractions are, however, suitable for use in producing delayed coker products.

Although the delayed coker unit is considered an economical and effective unit for making high quality products from low quality feeds, coker product yield and property distribution do depend on the type of feedstock available for coking. Thus, the refiner, to a certain degree, can control the coker products and the quality of coke by the choice of feedstock.

The delayed coking process is an established petroleum refinery process which is used on very heavy low value residuum feeds to obtain lower boiling cracked products. The lighter, lower boiling, components of the coking process can be processed catalytically, usually in the FCC unit, to form products of higher economic value. The solid coke product is used as is or is subjected to further processing.

Although the delayed coker unit is considered an economical and effective unit for making high quality products from low quality feeds, coker product yield and property distribution do depend on the type of feedstock available for coking. Thus, the refiner, to a certain degree, can control the coker products and the quality of coke by the choice of feedstock.

The main source of coker feedstocks include the bottoms of crude oil fractionators or vacuum columns, which are referred to as "short residuums" and "long residuums." The most common coker feedstocks are the short resids, or vacuum resids. These products have high metals and carbon contents. The hydrocarbon constituents in residuums are asphaltenes, resins, heterocycles and aromatics.

There are basically three different types of solid coker products which are different in value, appearance and properties. They are needle coke, sponge coke and shot coke. Needle coke is the highest quality of the three varieties. Needle coke, upon further treatment, has high conductivity and is used in electric arc steel production. It is low in sulfur and metals and is produced from some of the higher quality coker charge stocks which include more aromatic feedstocks such as slurry and decant oils from catalytic crackers and thermal cracking tars as opposed to the asphaltenes and resins.

Sponge coke, a lower quality coke, sometimes called "regular coke," is most often formed in refineries. Low quality refinery coker feedstocks having significant amounts of asphaltenes, heteroatoms and metals produce this lower quality coke. If the sulfur and metals content is low enough, sponge coke can be used for the manufacture of electrodes for the aluminum industry. If the sulfur and metals content is too high, then the coke can be used as fuel. The name "sponge coke" comes from its porous, sponge-like appearance.

Shot coke has been considered the lowest quality coke because it has the highest sulfur and metals content, the lowest electrical conductivity and is the most difficult to grind. The name shot coke comes from its shape which is similar to that of B-B sized balls. The shot coke has a tendency to agglomerate into larger masses, sometimes as much as a foot in diameter which can cause refinery equipment and processing problems. Shot coke is made from the lowest quality high resin-asphaltene feeds and makes a good high sulfur fuel source. It can also be used in cement kilns and steel manufacture.

Since recent refinery techniques in fluid catalytic cracking allow conversion of traditional coker feedstocks such as the high boiling hydrocarbons and residuum mixtures and heavy residuum feeds to lighter materials suitable for regular gasoline, high octane gasolines, distillates and fuel oils, refiners are finding it difficult to obtain the feedstocks necessary for making the solid coker products which are considered more valuable such as the needle coke and anode grade coke. The feedstocks available for coking are high resin-asphaltene feeds which cannot, yet, be processed effectively and efficiently in the FCC unit to produce gasoline, but which can be used to make shot coke.

In the delayed coking process, which is essentially a high severity thermal cracking, the heavy oil feedstock is heated rapidly in a fired heater or tubular furnace from which it flows directly to a large coking drum which is maintained under conditions at which coking occurs, generally with temperatures above about 450° C. under a slight superatmospheric pressure. In the drum, the heated feed decomposes to form coke and volatile components which are removed from the top of the drum and passed to a fractionator. When the coke drum is full of solid coke, the feed is switched to another drum and the full drum is cooled and emptied of the coke product. Generally, at least two coking drums are used so that one drum is being charged while coke is being removed from the other.

When the coking drum is full of solid coke, the hydrocarbon vapors are purged from the drum with steam. The drum is then quenched with quench water to lower the temperature to about 200° F. after which the water is drained. When the cooling step is complete, the drum is opened and the coke is removed by hydraulic mining or cutting with high velocity water jets.

A high speed, high impact water jet cuts the coke from the drum. A hole is bored in the coke from water jet nozzles located on a boring tool. Nozzles oriented horizontally on the head of a cutting tool cut the coke from the drum.

Even though the coking drum may appear to be completely cooled, occasionally, a problem arises which is referred to in the art as a "hot drum." This problem occurs when areas of the drum do not completely cool. This may be the result of a combination of morphologies of coke in the drum resulting in a nonuniform drum. That is, the drum may contain a combination of more than one type of solid coke product, i.e., needle coke, sponge coke and shot coke. BB-sized shot coke may cool faster than another coke, such as large shot coke masses or sponge coke. Usually, the lower quality coke is at the bottom of the drum and the higher quality coke is at the top of the drum.

The formation of zones in the coker drum which are impervious to cooling water can slow down the decoking process because these zones do not cool as quickly as the other, more pervious, zones of the drum. Such large agglomerations of coke can result in areas of high temperature or "hot spots." This condition is difficult to detect and may not be noticed by operating personnel. If the condition is detected, bottlenecking of the refinery occurs because the coking unit is out of operation for a longer length of time which is necessary to cool the drum before cutting the coke from the drum.

Alkali metal-containing materials which are used in hydrocarbon product finishing processes such as caustic extraction (such as treating in a UOP Merox unit), caustic scrubbing, mercapfining and hydrogen sulfide removal from liquid and gaseous refined hydrocarbon products are usually removed from the finished product by washing with water. The wash containing spent alkali is difficult to dispose. Refining with alkali is described in Dalchevsky et al, *Petroleum Refining With Chemicals*, pp. 137–175 (1958) and Bell, *American Petroleum Refining*, pp. 297–325 (1945) which are incorporated herein by reference in their entireties. The components of the spent alkali metal-containing materials not only contain the alkali metals of spent caustic soda and spent caustic potash which are themselves incompatible with the natural environment, but also contain process contaminants such as sulfur containing compounds and other waste, including some organic materials along with large quantities of water. Although the alkali metal-containing materials can be treated prior to disposal by incineration or oxidation in the liquid phase, their re-use in the refinery would be preferred.

SUMMARY OF THE INVENTION

It has now been found that benefits to the refiner can be derived by introducing spent caustic to a delayed coking unit during coking of a conventional coker feedstock.

The spent caustic can be introduced directly to the coker drum during delayed coking. Alternatively, the alkali-metal material can be introduced to the coker feed prior to its injection into the coker drum.

DETAILED DESCRIPTION OF THE INVENTION

Figure 1:
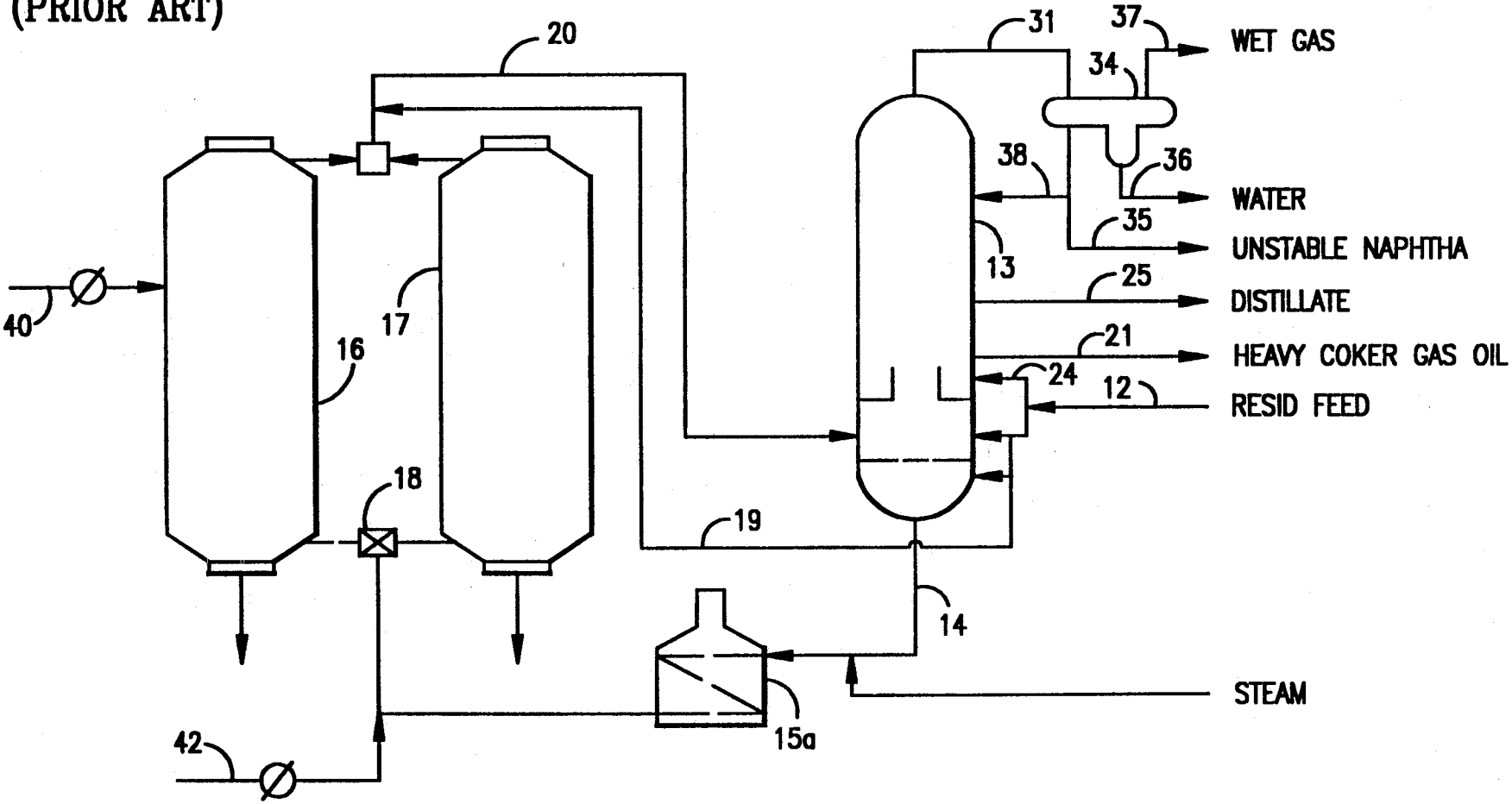
FIG. 1 (PRIOR ART)
FIG. 1 is a simplified schematic representation of the delayed coker unit showing the injection of the spent caustic.

The invention is directed to a process of recycling spent caustic soda and/or potash which are used in various refinery process.

It is an object of the invention to recycle spent refinery caustic soda and/or potash without inhibiting the coking process.

It is a feature of the invention to feed a spent refinery caustic soda and/or potash to a delayed coker drum during delayed coking of a feedstock which permits coking of the caustic soda along with the feedstock.

It is an advantage of this invention that when the spent caustic is fed to a coker drum, the morphology of the solid coke produced, as a result, comprises shot-coke.

A further advantage of the invention is that carrying out delayed coking of a coker feedstock in which spent caustic has been added directly to the coker drum during delayed coking of the feedstock results in more rapid coking and cooling of the drum tending to form the small BB-sized shot coke which in turn eliminates the "hot drum" problem.

The sources of alkali metals include caustic soda and caustic potash. Preferably, these are the spent alkali metal materials from the refining of heavy hydrocarbons to lighter hydrocarbon products. The fresh caustic solutions are used as physical solvents to extract sulfur-containing compounds from refined products. The caustic is removed, usually by phase separation and water wash, the resulting waste is the spent caustic. Examples are spent caustics from caustic extraction (such as from a UOP Merox unit), caustic scrubbing, mercapfining and hydrogen sulfide removal from liquid products or gases.

The spent caustic from these processes contain the alkali metals, i.e. Na and K, sulfur and other wastes, including organic contaminants which vary depending upon the hydrocarbon source but can be organic acids, dissolved hydrocarbons, phenols, naphthenic acids and salts of organic acids. The hydrocarbon content is typically less than 10 wt. %. Specific sulfur-containing materials include sodium sulfides (i.e. NaHS, $Na_2S$), sodium mercaptides and disulfides, to name just a few. The spent caustic has a high water content, typically, containing about 50 wt. % to 95 wt. % water, more specifically about 65 wt. % to 80 wt. % water. Table 1 presents the composition of a typical spent caustic.

TABLE 1

Analysis of a Spent Caustic

| Composition | Weight % |
|---|---|
| Water | 70.00 |
| Hydrogen Sodium Sulfide | 23.00 |
| By-products and solvents | 2.00 |
| Sodium Bicarbonate | 1.00 |
| Sodium sulfide | 4.00 |

The above composition was determined by a combination of a wet test and other methods such as titration, steam distillation, colorimetric and gas chromatography.

These spent caustic and organic materials can pose disposal problems because they can be considered incompatible with the natural environment. Although incineration and oxidation in the liquid phase are fairly safe methods of treatment for disposal, a secondary beneficial application for these materials would be preferred. Although refinery caustics are most effective in the process, it is contemplated that other alkali-metal containing materials which are used in refinery processes will be effective.

In the contemplated delayed coking process of the invention, the heavy oil feedstock is heated rapidly in a tubular furnace to a coking temperature which is usually at least 425° C. (about 800° F.) and, typically 425° C. to 500° C. (about 800° F. to 930° F.). From there it flows directly to a large coking drum which is maintained under conditions at which coking occurs, generally with temperatures of about 430° C. to 450° C. (about 800° F. to 840° F.) under a slight superatmospheric pressure, typically ranging from 0 to 100 and more specifically from 5–100 psig. In the coking drum, the heated feed thermally decomposes to form coke and volatile liquid products, i.e., the vaporous products of cracking which are removed from the top of the drum and passed to a fractionator.

Typical examples of coker petroleum feedstocks which are contemplated for use in this invention, include residues from the atmospheric or vacuum distillation of petroleum crudes or the atmospheric distillation of heavy oils, visbroken resids, tars from deasphalting units or combinations of these materials. Typically, these feedstocks are high-boiling hydrocarbons that have an initial boiling point of about 350° F. or higher and an API gravity of about 0° to 20° and a Conradson Carbon Residue content of about 0 to 40 weight percent.

The process is best operated when the spent caustic is added to the hot coker feed; that is, downstream of the coker heater. Thus, the spent caustic can be introduced to the feed at a point before entry of the feed to the coker drum or directly to the coker drum through its own dedicated nozzle. To avoid premature quenching of the coker feedstock care should be taken to introduce the spent caustic at a rate and temperature sufficient to avoid quenching of the feedstock. When the caustic is trickled into the feedstock process stream at a slow rate, the temperature of the material can range from ambient temperature, above 70° F. to a slightly elevated temperature, i.e. about 100° F. to 175° F. When the spent caustic is introduced at a higher rate, it will probably be necessary to raise the temperature of the spent caustic to avoid a quenching effect on the process stream. Thus, the temperature can be raised up to the temperature of the process stream or the coker feedstock; that is, as high as 930° F. It should be noted, however, that the spent caustic should not be heated to a temperature which is high enough to promote deposition of the alkali metals in the lines used to convey the material to the process stream.

A delayed coker unit in accordance with the invention is shown in FIG. 1. The heavy oil feedstock enters the unit through conduit 12 which brings the feedstock to the fractionating tower 13, entering the tower below the level of the coker drum effluent. In many units the feed also often enters the tower above the level of the coker drum effluent. The feed to the coker furnace, comprising fresh feed together with the tower bottoms fraction, generally known as recycle, is withdrawn from the bottom of tower 13 through conduit 14 through which it passes to furnace 15*a* where it is brought to a suitable temperature for coking to occur in delayed coker drums 16 and 17, with entry to the drums being controlled by switching valve 18 so as to permit one drum to be on stream while coke is being removed from the other. The vaporous products of the coking process leave the coker drums as overheads and pass into fractionator 13 through conduit 20, entering the lower section of the tower below the chimney. Quench line 19 introduces a cooler liquid to the overheads to avoid coking in the coking transfer line 20.

Heavy coker gas oil is withdrawn from fractionator 13 and leaves the unit through conduit 21. Distillate product is withdrawn from the unit through conduit 25. Coker wet gas leaves the top of the column through conduit 31 passing into separator 34 from which unstable naphtha, water and dry gas are obtained, leaving the unit through conduits 35, 36, and 37 with a reflux fraction being returned to the fractionator through conduit 38.

The spent caustic can be heated and added directly to the coke drum during filling through leading line 40. Alternatively, the spent caustic is introduced to the coker feed through line 42. In another alternative spent caustic is introduced through both lines 40 and 42.

Up to about 5000, or more, ppm of the alkali metal-containing material is introduced to the delayed coking unit. The inorganic contaminants in the spent caustic are incorporated into the coke as minor contaminants. Light organic components of the caustic are incorporated into the light coker products.

When the spent caustic is heated, preferably, heating is conducted in a heater dedicated to the spent caustic. Heating the caustic together with the coker feedstock in the same furnace is undesirable because there is a likelihood of premature coking which, at worst, can permanently damage the heater, at best, can cause production delays by increasing downtime necessary to decoke the coker feed heater and process lines. The caustic heater can be a tubular furnace or fired heater or other suitable apparatus.

It was found that adding the caustic in this manner has a beneficial effect on the coking process and the coke product. The refiner can predict with better accuracy the morphology of the coke product because the caustic drives the coke drum to produce shot coke with a reasonable degree of predictability. Since "hot drum" problems are mostly an issue when the coke morphology is unknown, the advantage to the refiner of knowing that the drum contains shot coke outweighs the value of running the unit to produce greater quantities of higher quality coke. Moreover, the significant expense to the refiner of producing more valuable coke by introducing more expensive feeds to the coker unit places greater importance on improving the process for making shot coke. Also the addition of spent caustic can enable the refiner to run the delayed coking unit at lower operating temperatures. That is, a high temperature and low pressure will ordinarily drive the drum towards the manufacture of shot coke. Thus, the addition of spent caustic is expected to produce a drum of shot coke at a lower operating temperature which is an economical advantage to the refiner.

The refinery-derived alkali metal-containing material is a small waste stream which is relatively low in volume amount compared to the amount of the coker feedstock. Thus, the alkali material can be added to the unit continuously or in intermittent intervals based on availability.

The process maximizes recovery of volatile organics from the coke by coking at lower hydrocarbon partial pressure and by promoting steam stripping. The water which is in the spent caustic in significant amounts turns to steam during preheating or upon introduction to the coker drum. This facilitates stripping of the volatile organics contained in the spent caustic. The steam also encourages the drum to generate shot coke.

The formation of shot coke in accordance with this invention is advantageous because the caustic accelerates drum cooling making shot coke a safe and efficient coker product.

In another embodiment of the invention the spent caustic can be used to quench the hot coke. In this manner, the spent caustic is used as is or is added to the quenching fluid, usually water, to quench the coke prior to its removal. The hydrocarbon constituent (usually <10% by weight) would be recovered in the reaction blowdown.

The following experiments were conducted in an autoclave under conditions which simulate a delayed coker unit using a vacuum resid, unless otherwise indicated.

EXAMPLE 1

About 50 grams of coker feedstock, a vacuum resid, was fed to the autoclave and maintained at delayed coking conditions of 840° F. and 12 psig. Four grams of hot water were added to the coker to provide comparable conditions to caustic coking but without the presence of alkali metals (e.g. NaOH). During coking, the coke make versus time were evaluated at intervals to determine the rate of coke production. The results are presented in the graph shown in FIG. 2.

EXAMPLE 2

Delayed coking of a feedstock was conducted in a manner similar to Example 1, except that 4 grams of hot 10% NaOH solution were added to the autoclave along with the coker feedstock. When coking was completed, the morphology of the coke product was determined to be shot coke. During coking, the coke make versus time were evaluated at intervals to determine the rate of coke production. The results are presented in the graph shown in FIG. 2.

EXAMPLE 3

Delayed coking of a feedstock was conducted in a manner similar to Example 2, except that 4 grams of a hot refinery-derived waste caustic were fed to the autoclave along with the coker feedstock. The morphology of the coker product was determined to be shot coke. The coke make versus time were evaluated at intervals to determine the rate of coke production. The results are also presented in the graph shown in FIG. 2.

Figure 2:
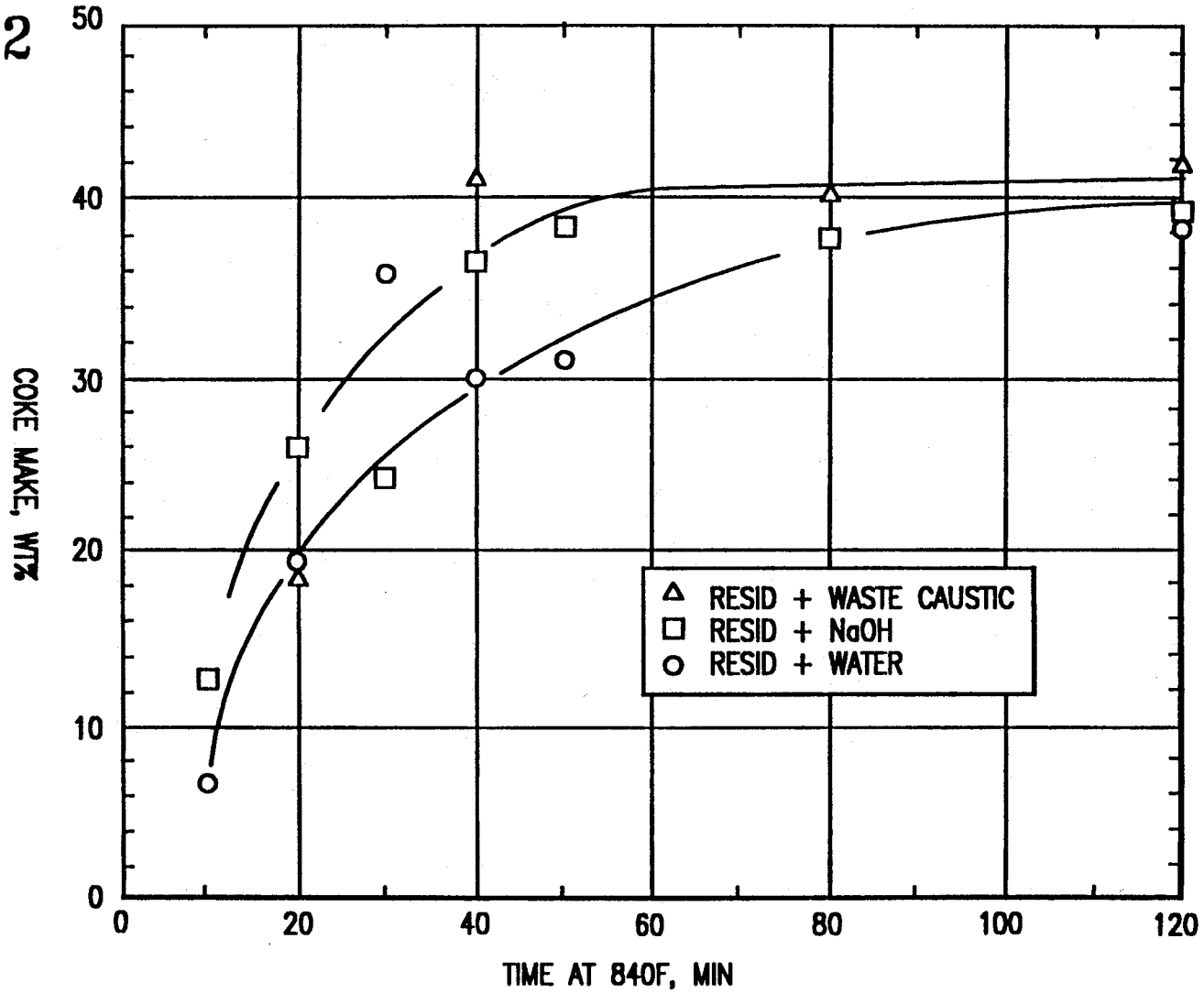
FIG. 2 is a plot of coke make in weight vs. time for a laboratory scale batch coker.

The weight % coke make v. time plot of FIG. 2 which was determined from the data collected from the runs of Examples 1–3, and the coke yields at various intervals show that adding fresh or spent caustic to a delayed coker drum while conducting delayed coking of a feedstock increases the coke production rate compared to the rate of coke production from coke made in the conventional manner.

This example illustrates the effect on cooling time and cooling fluid reduction by the injection of a spent caustic at higher coking temperatures.

EXAMPLE 4

A vacuum tower residue feed stock was fed to the coker under 33–36 psig pressure, temperature of about 888° F. using a spent caustic flow of about 3 GPM and a heater charge of 22.0 MB/D, a commercial silicone antifoam was injected in a ratio of antifoam to gas oil of 50:1 before introduction of the spent caustic. Caustic injection was discontinued after about 10 hours. Coking was discontinued after about 14 hours.

The final coker product was cooled by filling the drum with water. Total cooling water added to the drum was 300,000 gallons, indicating that the coke was of good porosity and permeability. The coke cutting time was 70 minutes and the coke was easily cut from the drum. Samples of the coke indicated that it was very similar to coke produced in the absence of spent caustic. The coke was about 50% shot coke, with the other 50% being sponge coke with a significant amount of fines. This loose consistency was attributed to the relatively rapid cutting time.

From the results of this experiment, it is apparent that spent caustic addition has the beneficial effect of accelerating coking time and facilitating cooling and cutting of the solid coker product.

What is claimed is:

1. A delayed coking process comprising the steps of a) introducing a residuum hydrocarbon fraction coker feed to a coker heater which elevates the temperature of the coker feed to a temperature ranging from about 800° F. to 930° F. necessary to carry out coking of the feed;

b) adding a spent caustic to the heated coke feed to produce a coker feedstock, the spent caustic is added at a temperature ranging from 70° F. to the temperature of the heated coker feed; and c) carrying out coking of the coker feedstock in a coker drum at an elevated coking temperature and a slight superatmospheric pressure from which solid coke comprising shot-grade solid coke and liquid coker products are removed.

2. The process of claim 1 in which the spent caustic contains from about 50 wt. % to 95 wt. % water.

3. The process of claim 1 in which the spent caustic contains from 65 wt. % to 80 wt. % water.

4. The process as described in claim 1 in which the spent caustic is derived from a process of treating a refined hydrocarbon product with a fresh caustic; and separating the spent caustic from the treated refined hydrocarbon product by phase separation and water washing.

5. The process as described in claim 4 in which the spent caustic is derived from caustic extraction or caustic scrubbing of refined hydrocarbon product.

6. The process as described in claim 1 in which the spent caustic comprises a refinery-derived caustic.

7. The process as described in claim 1 in which the spent caustic comprises a refinery-derived caustic potash.

8. The process as described in claim 1 in which the hydrocarbon coker feedstock is a vacuum resid.

9. The process as described in claim 1 in which up to 5000 ppm of the spent caustic is introduced to the coking drum based on the entire weight of the delayed coker feedstock.

10. The process as described in claim 1 in which the process further comprises quenching the solid coke with a quench liquid which comprises a spent caustic.

11. A method of accelerating coking of a residuum hydrocarbon fraction substantially free of excess alkali metals, comprising:

introducing the residuum hydrocarbon fraction as a coker feed to a coker heater which elevates the temperature of the coker feed to a temperature ranging from about 800° F. to 930° F. necessary to carry out coking of the feed;

separating a spent caustic from a caustic-treated refined hydrocarbon product by phase separation and water wash to produce a spent caustic which is substantially free of hydrocarbon coke precursors;

elevating the temperature of the spent caustic to an elevated coking temperature;

introducing the spent caustic to the heated coker feed to produce a coker feedstock; and carrying out coking of the coker feedstock in a coker drum at an elevated coking temperature and a slight superatmospheric pressure to produce a highly porous solid coke product comprising shot-grade solid coke.

12. The process as described in claim 11 in which the spent caustic contains from about 50 wt. % to 95 wt. % water.

13. The process as described in claim 11 in which the spent caustic contains from about 65 wt. % to 80 wt. % water.

14. The process as described in claim 11 in which up to 5000 ppm of the alkali metal-containing material is introduced to the coking drum based on the entire weight of the delayed coker feedstock.

15. The process as described in claim 11 in which the process further comprises quenching the solid coke with a quench liquid which comprises spent caustic.

* * * * *